US009119260B2

(12) United States Patent
Sempel

(10) Patent No.: US 9,119,260 B2
(45) Date of Patent: Aug. 25, 2015

(54) ILLUMINATION SYSTEM COMPRISING A PLURALITY OF LEDS

(75) Inventor: Adrianus Sempel, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 248 days.

(21) Appl. No.: 13/988,140

(22) PCT Filed: Nov. 15, 2011

(86) PCT No.: PCT/IB2011/055099

§ 371 (c)(1), (2), (4) Date: May 17, 2013

(87) PCT Pub. No.: WO2012/069961

PCT Pub. Date: May 31, 2012

(65) Prior Publication Data

US 2013/0234619 A1 Sep. 12, 2013

(30) Foreign Application Priority Data

Nov. 25, 2010 (EP) ..... 10192617

(51) Int. Cl.
*H05B 33/02* (2006.01)
*H05B 33/08* (2006.01)

(52) U.S. Cl.
CPC ..... *H05B 33/0848* (2013.01); *H05B 33/0827* (2013.01); *H05B 33/0863* (2013.01)

(58) Field of Classification Search
CPC ..... H05B 37/02; H05B 37/029
USPC ..... 315/185 S, 292–295, 186, 193, 194, 315/291, 297
See application file for complete search history.

(56) References Cited

U.S. PATENT DOCUMENTS

| | | | | |
|---|---|---|---|---|
| 6,737,814 | B2 * | 5/2004 | Guthrie et al. | 315/200 A |
| 2002/0024426 | A1 | 2/2002 | Latham et al. | |
| 2002/0047605 | A1 | 4/2002 | Guthrie et al. | |
| 2006/0202915 | A1 | 9/2006 | Chikugawa | |
| 2009/0278473 | A1 | 11/2009 | Van Erp | |

FOREIGN PATENT DOCUMENTS

| | | | |
|---|---|---|---|
| DE | 10214195 | A1 | 10/2003 |
| DE | 102005014612 | A1 | 10/2006 |
| EP | 2375861 | A2 | 10/2011 |
| WO | W02008127839 | A1 | 11/2006 |
| WO | W02010055456 | A1 | 5/2010 |

* cited by examiner

*Primary Examiner* — Hai L Nguyen
(74) *Attorney, Agent, or Firm* — Yuliya Mathis

(57) ABSTRACT

An illumination system (100)comprises: an LED system (120) comprising two or more LED groups (21, 22, 23, 24; 451, 452) and current distribution means (140), wherein each LED group includes one or more individual LEDs, the LED system (120) having two input terminals (121, 122); a single controllable driver (130) for providing working power to the LED system (120), the driver having two output terminals (131, 132) coupled to the two input terminals (121, 122) of the LED system (120), respectively; a control device (2) for controlling the driver (130); wherein the control device (2) is designed for controlling the driver output voltage (Vi); and wherein the current distribution means are responsive to the input voltage (Vi) at the input terminals of the LED system for drawing current from the driver and distributing the current among the different LED groups in dependence on the input voltage level.

15 Claims, 12 Drawing Sheets

ILLUMINATION SYSTEM COMPRISING A PLURALITY OF LEDS

FIELD OF THE INVENTION

The present invention relates in general to the field of illumination. Particularly, the present invention relates to an illumination system comprising a plurality of LEDs and being capable of generating a light output with a controllable color point.

BACKGROUND OF THE INVENTION

Illumination systems for generating light are commonly known, and the same applies to the use of LEDs as light source in such illumination systems. Therefore, a detailed explanation thereof will be omitted here.

Generally speaking, one may define several operational requirements for an illumination system. An obvious requirement is that the system can be switched ON and OFF. A second requirement is dimmability: it is desirable that the intensity of the light output can be varied. A third requirement is color variability: it is desirable that the color of the light output can be varied.

With respect to color, it is commonly known that colors as perceived by the human eye can be described in a two-dimensional color space. In this space, pure or monochromatic colors, i.e. electromagnetic radiation having one frequency within the visible spectrum, are located on a curved line having two end points, corresponding to the boundaries of the visible spectrum. This curve, together with a straight line connecting said end points, forms the well-known color triangle. Points within this triangle correspond to so-called mixed colors. An important feature of colors is that, when the human eye receives light originating from two light sources with different color points, the human eye does not distinguish two different colors but perceives a mixed color, wherein the color point of this mixed color is located on a straight line connecting the two color points of the two light sources, while the exact position on this line depends on the ratio between the respective light intensities. The overall intensity of the mixed color corresponds to the respective light intensities added together. Thus, it is possible to generate light having a color point corresponding to any desired point of said line with, within limits, any desired intensity. Similarly, with three light sources, it is possible to render any color point within the triangle defined by the three respective color points.

In the field of illumination, there is a general desire to be able to generate light of which the color can be controlled. Depending on the type of application, the desired characteristics of the illumination system may be different. A specific type of illumination system is a daylight lamp capable of generating white light and/or capable of simulating the change in light color of daylight from sunrise to sunset. Another specific type of illumination system is a replacement for an incandescent lamp, having the same "warm" light output.

While the above basically applies to any type of light source, a light source particularly suitable in color systems is the LED, in view of its size and cost, and considering the fact that an LED produces monochromatic light. Thus, illumination systems have been developed comprising 3 or 4 (or even more) different LED types. By way of example, the RGBW system is mentioned, comprising RED, GREEN, BLUE and WHITE LEDs.

In order to be able to achieve dimmability in an LED system, it is known to apply pulse width modulation: instead of a constant current, the LED receives current pulses of a certain duration at a certain repetition frequency, selected to be sufficiently high such as not to lead to perceivable flicker.

For driving an LED, an LED driver is used, capable of generating the required LED current at the corresponding drive voltage.

In order to be able to set and/or vary a desired color point of the light output, it is necessary to be able to individually vary the intensities of the different colors. While a simple system may comprise one LED per color, practical systems usually have a plurality of LEDs per color. It is possible to drive an array of LEDs by one common driver, and the LEDs may be connected in parallel or in series, or both. Nevertheless, the prior art requires that there be at least one driver per color. This makes such a system relatively costly. Further, between driver system and LED system at least 5 wires are needed, even 8 wires if it is undesirable to have a common ground.

SUMMARY OF THE INVENTION

An important object of the present invention is to provide an illumination system comprising 4 different LED groups driven by one common driver, in which dimmability and color variability are possible. The gist of the present invention is also applicable, however, in an illumination system comprising 2 or 3 different LED groups, or comprising 5 or more different LED groups.

In state of the art technology, an LED driver is typically implemented as a current source. As commonly known by persons skilled in the art, an LED, like any other type of diode, has as a characteristic an almost constant voltage when in its forward conductive state, indicated as forward voltage. Thus, while the driver output current is determined by the driver, the driver output voltage is determined by the LED. According to the present invention, an illumination system comprises a controllable current distribution means having one input receiving the driver current and having a plurality of outputs coupled to the respective LED groups for providing the respective LED currents. Further, the driver actively sets its output voltage, which is used as a control signal for the current distribution means. Depending on this control signal, the current distribution means sets a specific ratio of the respective LED currents.

In one implementation, the controllable current distribution means may comprise a processor provided with a memory containing information defining a relationship between input voltage and output current ratio. In another implementation, the controllable current distribution means consists of a specific hardware configuration of the LED system.

Further advantageous elaborations are mentioned in the dependent claims.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF EMBODIMENTS

Figure 1:
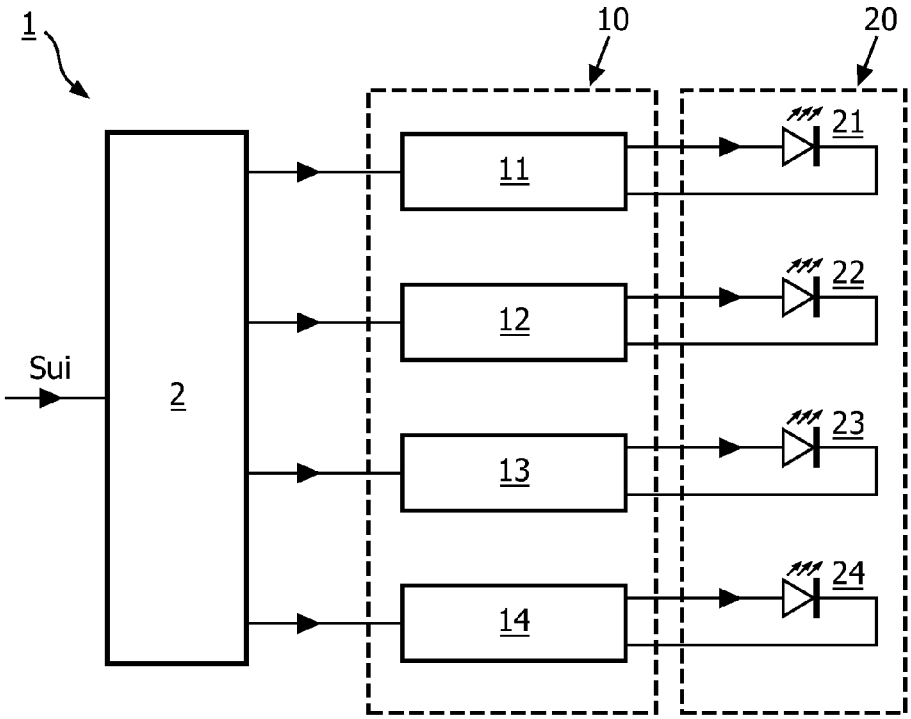
FIG. 1 shows a block diagram schematically illustrating a prior art design of an illumination system.

FIG. 1 shows a block diagram schematically illustrating a prior art design of an illumination system 1 comprising driver means 10 and an LED system 20, wherein in this example the LED system 20 comprises four LEDs 21, 22, 23, 24. In the prior art design, the driver means 10 actually comprises individual drivers 11, 12, 13, 14 dedicated to driving a corresponding one of the LEDs 21, 22, 23, 24. In order to be able to set or vary the output color of the LED system 20 as a whole, for instance by a user action, the illumination system 1 comprises a control device 2 receiving a user input signal Sui and calculating individual driver control signals for the individual drivers 11, 12, 13, 14. The figure clearly shows that eight wires are needed to connect the driver means 10 to the LED system 20.

Figure 2:
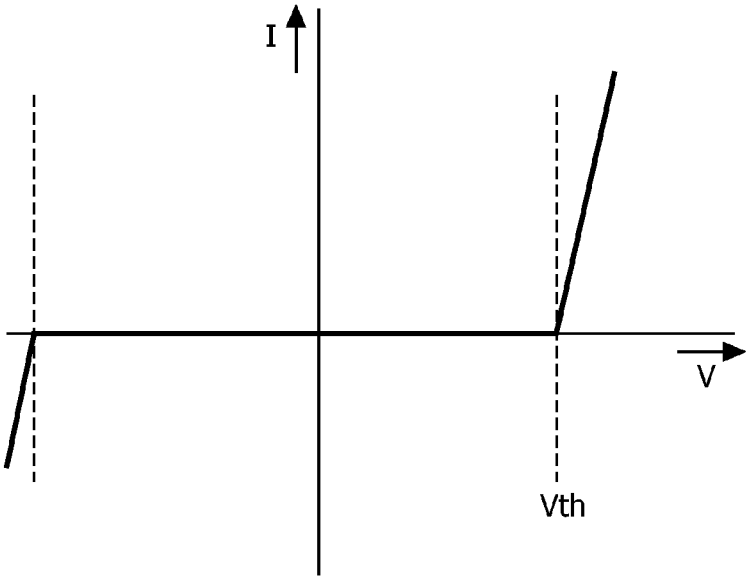
FIG. 2 is a graph schematically illustrating the electrical behaviour of a diode.

FIG. 2 is a graph schematically illustrating the electrical behaviour of a diode, particularly an LED. The horizontal axis represents voltage (arbitrary units), the vertical axis represents current (arbitrary units). A diode has two terminals, one being indicated as anode and the other being indicated as cathode. Assuming that a DC voltage is applied across the diode terminals, with the anode being positive and the cathode being negative; this will be indicated as positive bias (righthand side of the graph). As long as the voltage magnitude is below a certain threshold value Vth, the current may be considered to be zero and the diode is said to be non-conductive (it is noted that in reality a very small current may flow, but this is neglected here). If the voltage magnitude is above said threshold value Vth, the current rises very steeply as a function of voltage and the diode is said to be forwardly conductive.

When the polarity of the DC voltage is reversed, this will be indicated as negative bias or reverse bias (lefthand side of the graph). In practical conditions relevant to the present invention, the current is zero. In extreme conditions, when the voltage magnitude becomes very high, the diode does show conduction, as illustrated in the graph, but this will typically involve damaging the diode and is not considered to be a normal operative condition.

Thus, for explaining the present invention, three situations will be distinguished:

1) diode voltage drop negative, non-conductive
2) diode voltage drop positive<Vth, non-conductive
3) diode voltage drop positive≥Vth, conductive It is noted that the threshold voltage Vth may be considered to be constant for a single diode specimen, although the value may be different for different types of diode. For instance, for a standard germanium diode, Vth is about 0.3 V, for a standard silicium diode, Vth is about 0.7 V, and for power LEDs, Vth may be in the range of 1 V to 3 V.

In principle, it is possible that a driver 11, 12, 13, 14 has the characteristics of a voltage source: the load determines the current, and by precisely controlling the voltage, it is possible to set the current. However, slight variations in the voltage result in large variations in the LED current, while the LED output intensity may be considered to be substantially proportional to the LED current, so that visible intensity variations may result. Therefore, it is typically preferred that a driver has the characteristics of a current source. If this is the case, the load determines the output voltage of the driver. Thus, in both cases, the driver output power is determined by the load.

Figure 3:
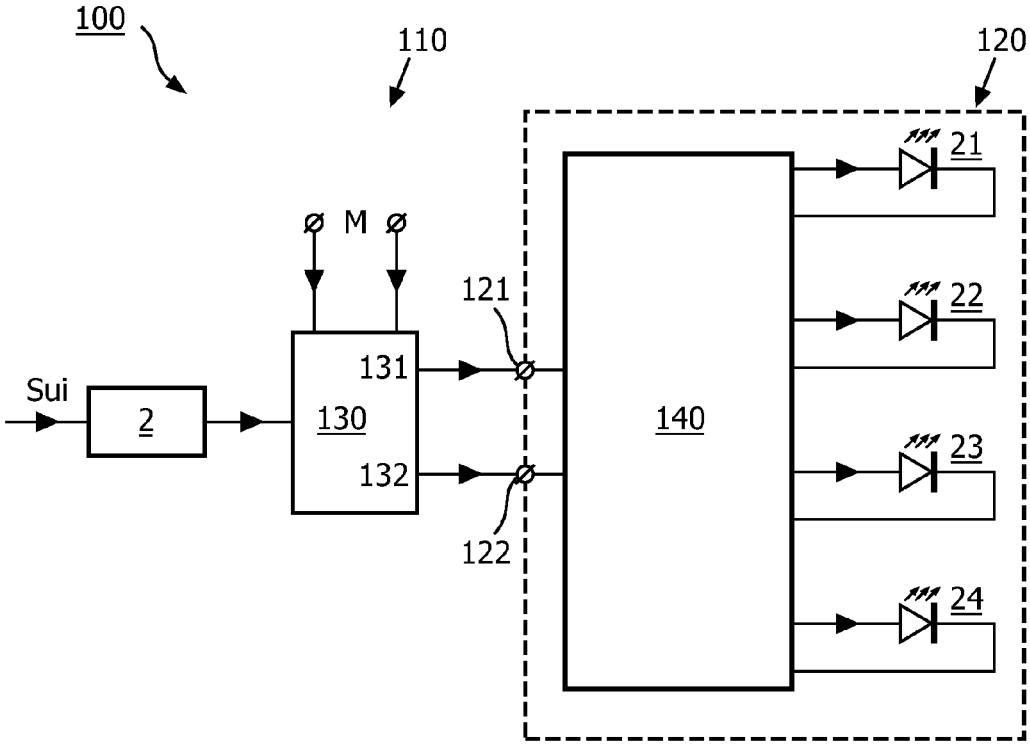
FIG. 3 is a block diagram schematically illustrating the design of an illumination system according to one embodiment of the present invention.

FIG. 3 is a block diagram schematically illustrating the design of an illumination system 100 according to one embodiment of the present invention. Again, this system has driver means 110 and an LED system 120 comprising four LEDs 21, 22, 23, 24. Unlike the prior art, the driver means 110 comprises just one driver 130 having output terminals 131, 132, and the LED system 120 having input terminals 121, 122 comprises controllable current distribution means 140. The figure shows that the driver 130 is powered from the mains M, but it is noted that this, although typical, is not essential. A control device 2 may receive a user input signal Sui, and may control the driver 130. It is noted that this control device and driver may be integrated.

When implementing the present invention, it is again possible that the driver 130 has the characteristic of a current source. However, it is now preferred that the driver 130 has the characteristic of a voltage source. For defining the protective scope and hence the wording of the claims, the precise characteristic of the driver should not be interpreted as being a limiting factor. While an ideal voltage source has a vertical characteristic and an ideal current source has a horizontal characteristic, a realistic power source typically has a sloping characteristic intersecting both the current axis and the voltage axis. Nevertheless, in all cases, an LED driven by the driver may have the same working point (a point in the graph of FIG. 2 defined by the combination of actual voltage and actual current). Since this working point establishes itself on the basis of the LED's characteristic, while the precise location on that characteristic is determined and varied by the driver output, the general phrase used in the claims will be that the driver provides working power. Nevertheless, in the following explanation it will be assumed that the driver 130 does have the characteristic of a voltage source, since such a characteristic is preferred as it allows the working voltage to be set easier.

As mentioned in the following explanation, it will be assumed that the driver 130 has the characteristic of a voltage source, and that the control device 2 is capable of setting the driver output voltage. It is noted that LED drivers having a controllable output voltage are known per se, so that a detailed explanation thereof is not needed here. According to the principles proposed by the present invention, the output voltage of the driver 130, i.e. the input voltage received by the current distribution means 140, is considered to be a control parameter for the distribution of the current among the LEDs 21, 22, 23, 24.

In a possible embodiment, the current distribution means 140 comprises an active processor and a memory containing information defining relationships between the control parameter "input voltage" Vi and the individual currents of the individual LEDs. With the number of individual LEDs equal to N, and an index i ranging from 1 to N, these relationships can be expressed as: $I_i=f_i(Vi)$ with the functions $f_i$ typically being mutually different such that together they define, for the color point of the overall light output, a certain predefined path in the color space. Preferably, for at least one LED or group of LEDs, the current (function $f_i$) is only non-zero within a certain range of input voltages, while this range overlaps with a range of input voltages where all other LEDs have zero current, so that in this overlap range the light output has the pure color of said one LED or group of LEDs. It is to be noted that the driver 130 supplies the summation of all LED currents.

In an embodiment which is preferred in view of its simplicity and low costs, the current distribution means 140 does not comprise active processor means but consists of the hardware configuration of the LED system 120. In the following, some exemplary embodiments will be discussed.

Figure 4A:
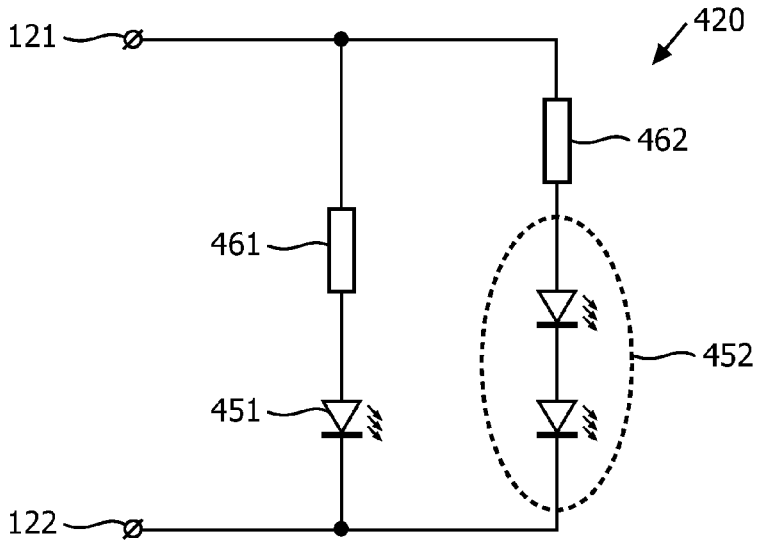
FIG. 4A is a block diagram schematically illustrating a possible embodiment of the LED system according to the present invention.

FIG. 4A is a block diagram schematically illustrating a possible embodiment of the LED system according to the present invention, indicated in general by the reference numeral 420. The input terminals are indicated by reference numerals 121, 122. The LED system 420 comprises two groups of LEDs 451, 452. These groups are connected in parallel to the input terminals 121, 122. An impedance 461 is connected in series with the first group 451 of LEDs. An impedance 462 is connected in series with the second group 452 of LEDs. In the following explanation, it will be assumed that this impedance is resistive, for instance a resistor.

In FIG. 4A, the first group 451 is shown by the symbol of a single LED, but this does not mean that there is only one LED in the first group. The group may actually comprise a plurality of LEDs arranged in series and/or in parallel with each other. These LEDs may be mutually identical, but the group may also comprise LEDs of mutually different colors. Apart from the LEDs, other electrical components may be connected in series and/or in parallel to the LEDs, for instance common diodes. While each individual LED or diode has its individual threshold voltage, as explained with reference to FIG. 2, the group 451 as a whole has a group threshold voltage VT1 which typically corresponds to the summation of the threshold voltages of LEDs arranged in series. Thus, if the group 451 consists of a series arrangement of three identical LEDs each having an individual threshold voltage Vth, the group threshold voltage VT1 of the group is equal to 3Vth.

The same applies to the second group 452. When comparing the second group 452 with the first group 451, there is one important difference: the second group 452 has a group threshold voltage VT2, hereinafter simply indicated as second threshold voltage, larger than the group threshold voltage VT1 of the first group 451, hereinafter simply indicated as first threshold voltage.

Further, the impedance value of the second impedance 462 in series with the second LED group 452 may differ from the impedance value of the first impedance 461 in series with the first LED group 451. The impedance value of the second impedance 462 may be smaller than the impedance value of the first impedance 461, and the second impedance 462 may even be omitted, in which case the function of second impendance will be performed by the series wiring of the second LED group 452.

Figure 4B:
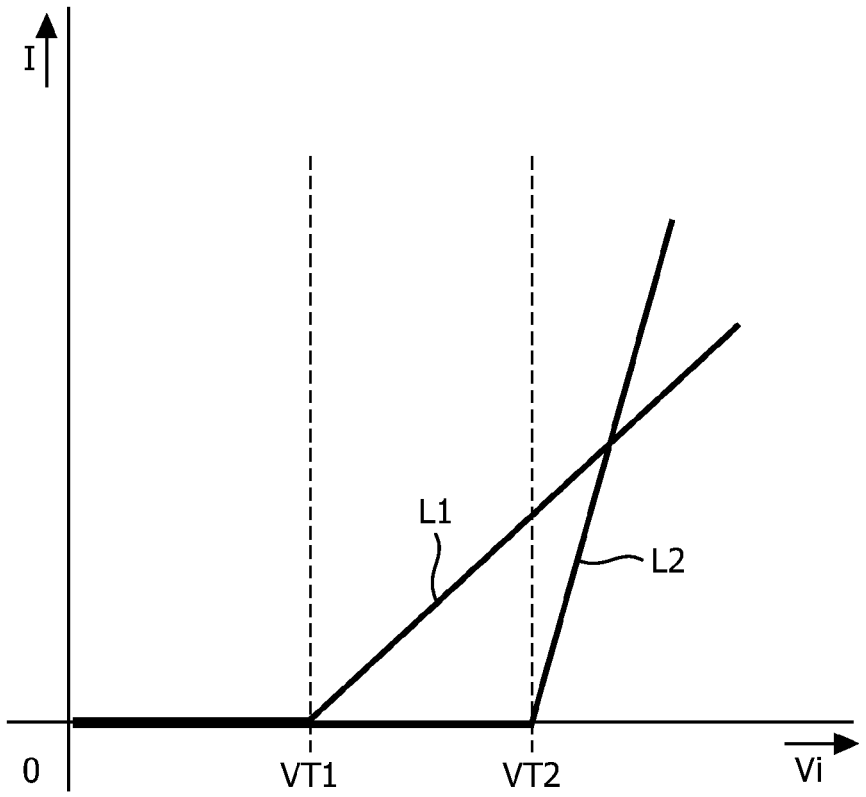
FIG. 4B is a graph showing the light output of the LED system of FIG. 4A as a function of the input voltage.

The operation of the LED system 420 will now be explained with reference to FIG. 4B, which is a graph showing the light output L1 of the first group of LEDs 451 and the light output L2 of the second group of LEDs 452 as a function of the input voltage Vi received at the input terminals 121, 122 of the LED system 420.

As long as Vi is smaller than VT1, all LEDs are off.

When Vi is higher than VT1 but still smaller than VT2, the second group of LEDs are still off Current will flow through the first group of LEDs 451, with a voltage drop developing across the first group of LEDs 451; this voltage drop will be almost equal to VT1. While in practice this voltage drop will increase slightly with increasing current (see FIG. 2), in the following explanation it will be assumed for the sake of convenience that the voltage drop is equal to VT1. The difference VR1=Vi−VT1 will be the voltage across the resistor 461, so that the current magnitude will be equal to (Vi−VT1)/R1, with R1 indicating the resistance of the resistor 461. This current is proportional (in reality: almost linearly proportional) to the input voltage Vi, and hence the first light output L1 is proportional to the input voltage Vi. The light output of the LED system 420 as a whole has the first color point.

It is noted that the above applies when R1 is sufficiently large. When R1 is too low, the current will be determined by the LED characteristics of the first group 451: the current cannot become higher than the current of the diode characteristic.

Similarly, when Vi is higher than VT2, current will also flow through the second group of LEDs 452, with a voltage drop taken to be equal to VT2 developing across the second group of LEDs 452. The difference VR2=Vi−VT2 will be the voltage across the second resistor 462, so that the current magnitude will be equal to (Vi−VT2)/R2, with R2 indicating the resistance of the second resistor 462. This current is proportional to the input voltage Vi, and hence the second light output L2 is proportional to the input voltage Vi. It should be clear that the first light output L1 is still proportional to the input voltage Vi.

The ratio between R1 and R2 determines the ratio between the proportionality of L1 and L2 versus Vi, respectively. Typically, it will be advantageous if R2 is smaller than R1, so that the current in the second group 452 rises faster as a function of Vi as compared to the current in the first group 451, and it will be advantageous if the number of LEDs in the second group 452 is larger than the number of LEDs in the first group 451, such that all in all the second light output L2 rises faster than the first light output L1, as illustrated.

In the above explanation, for understanding the electrical behaviour of the circuit, the color points of the LEDs do not play any role. All individual LEDs may even be mutally identical. In a particularly preferred embodiment, the group color point of the light output of all LEDs of the second group combined, hereinafter simply indicated as second color point, differs from the group color point of the light output of all LEDs of the first group combined, hereinafter simply indicated as first color point. When all LED groups are placed relatively closely together, a human observer will perceive the overall light output as a blend having one blend color point. When increasing the input voltage Vi, this blend color point travels in a straight line from the first color point towards the second color point. In the embodiment where the first color point is red and the second color point is white, increasing the input voltage causes a change from red light to warm white light, which corresponds to the dimming of an incandescent lamp.

Figure 4C:
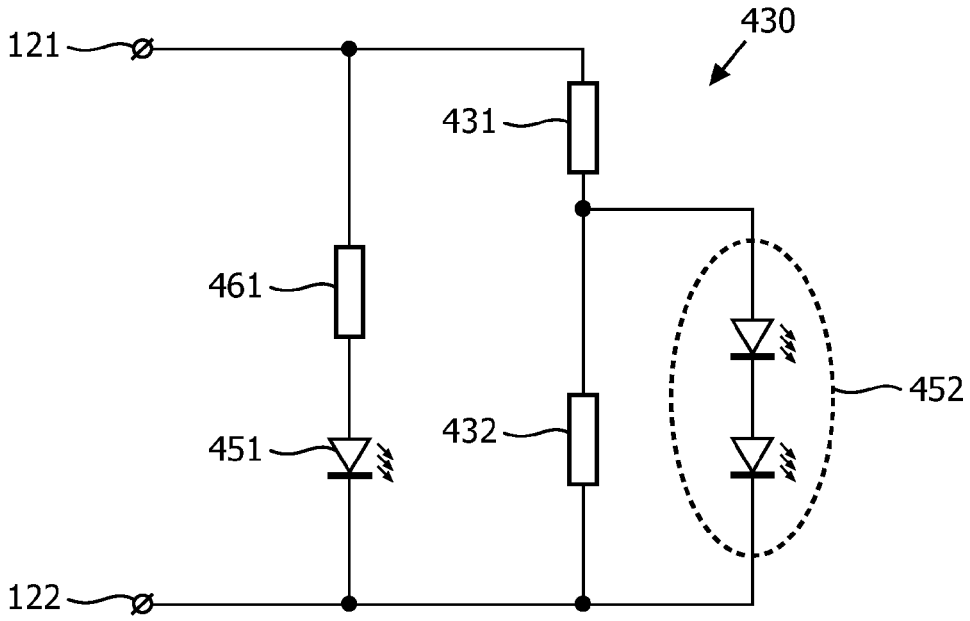
FIG. 4C is a block diagram schematically illustrating a possible embodiment of the LED system according to the present invention.

FIG. 4C illustrates a second embodiment 430, in which the second group of LEDs 452 is connected to a node of a voltage divider 430 formed by two resistors 431, 432 connected in series between the input terminals 121, 122. Thus, this node provides a voltage derived from the input voltage Vi. Even if the second group threshold voltage VT2 is lower than the first group threshold voltage, the second group 452 can only start to conduct if the input voltage Vi is equal to or higher than (R432+R431)/R432 times VT2.

Figure 5A:
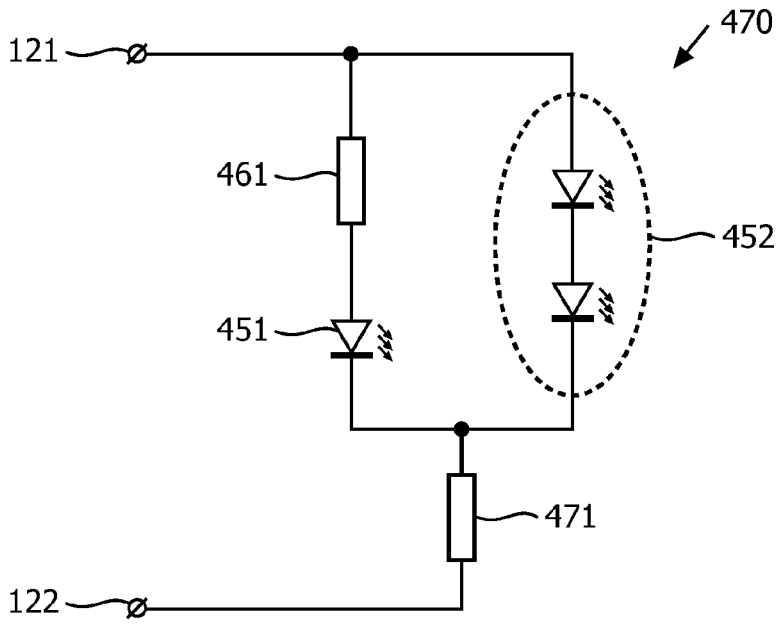
FIG. 5A is a block diagram schematically illustrating a possible embodiment of the LED system according to the present invention.
Figure 5B:
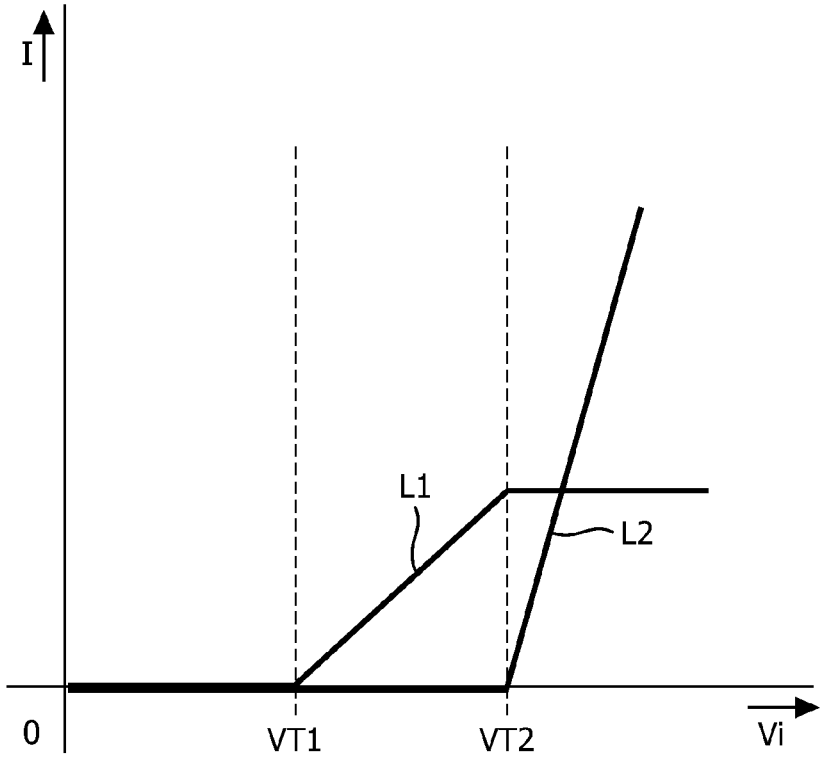
FIG. 5B is a graph showing the light output of the LED system of FIG. 5A as a function of the input voltage.

FIG. 5A illustrates a third embodiment 470. FIG. 5B is a graph comparable to FIG. 4B, illustrating the behaviour of this third embodiment 470. As compared to the first embodiment 420, the second resistor 462 is replaced by a resistor 471 in series with the parallel arrangement of first group 451 and second group 452. For Vi smaller than VT2, the operation is the same as the operation of the first embodiment 420, with this difference that the current magnitude will be equal to (Vi−VT1)/(R1+R3), with R3 indicating the resistance of the common series resistor 471.

When Vi is higher than VT2, current will also flow through the second group of LEDs 452, with a voltage drop VT2 developing across the second group of LEDs 452. The difference VR3=Vi−VT2 will be the voltage across the second resistor 471, and the voltage across the first group of LEDs 451 plus series resistor 461 will be clamped to VT2, as a result of which the first current L1 will remain constant.

In the embodiments as described above, where the LEDs are mounted closely together and the groups have mutually differing color points, varying the driver output voltage will result in the LED system 420; 470 as a whole generating a blend light output of which the color point travels in a straight line from the first color point towards the second color point. In an illustrative embodiment, the first color point is substantially red and the second color point is substantially white. In the simplest embodiment, the first group 451 consists of precisely one red LED and the second group 452 consists of precisely two white LEDs arranged in series.

However, the blend color point will not quite reach the second color point, because the first group 451 is on at all times when the second group 452 is on.

On the other hand, there are also embodiments where the light colors may even be mutually equal. For instance, embodiments are possible where the individual LED groups are placed at a substantial distance from each other, so that for the human observer the light generated by the first group of LEDs originates from a different location than the light generated by the second group of LEDs. This can be used for generating special light effects, such as for instance running lights, a light tube, etc. Also in such embodiment, it would be desirable to be able to switch off the first group while the second group is on.

Figure 6A:
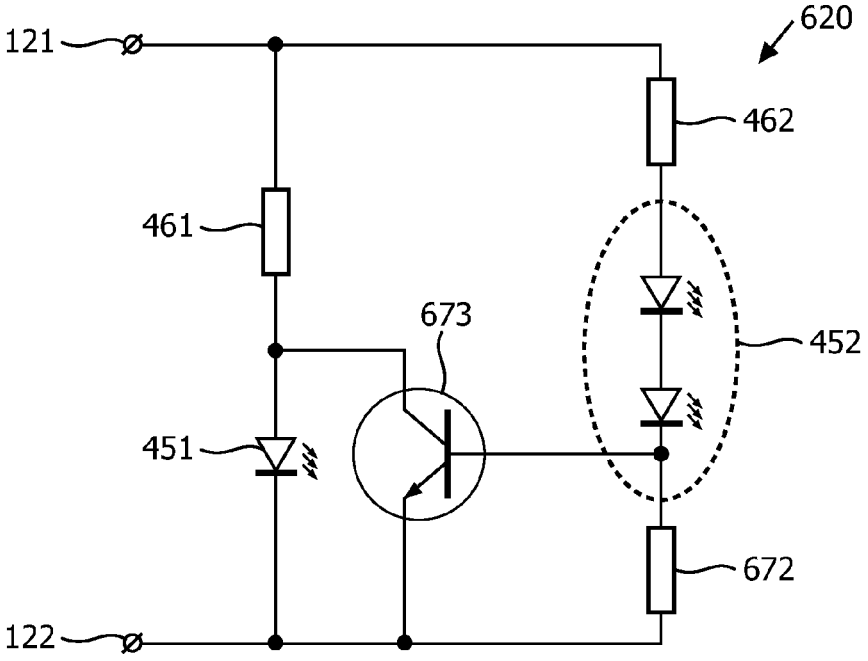
FIG. 6A is a block diagram schematically illustrating a possible embodiment of the LED system according to the present invention.

The present invention also provides embodiments where such a first group 451 is switched off FIG. 6A illustrates a fourth embodiment 620 of the LED system, comparable to the first embodiment 420 of FIG. 4A, where a current measuring sensor 672 is arranged between the cathode terminal of the second group 452 and the second input terminal 122, and where an NPN transistor 673 is arranged having its base terminal connected to the node between the current measuring sensor 672 and the second group of LEDs 452, having its emitter terminal connected to the second input terminal 122, and having its collector terminal connected to the node between the first resistor 461 and the first group of LEDs 451. It is noted that, instead of an NPN transistor, another type of controllable switch can be used, for instance a FET.

Figure 6B:
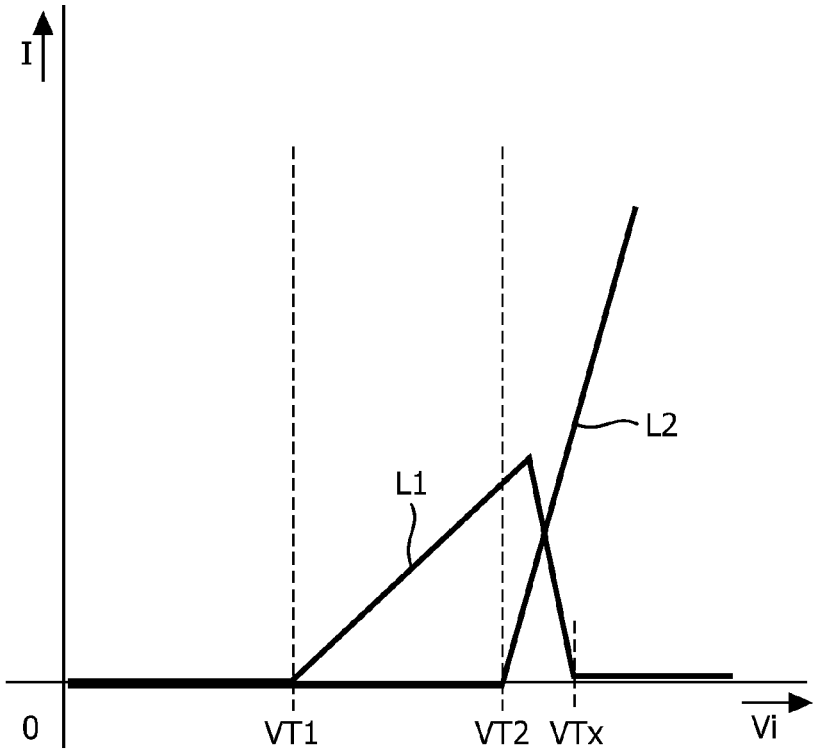
FIG. 6B is a graph showing the light output of the LED system of FIG. 6A as a function of the input voltage.

The operation is as follows. For Vi smaller than VT2, the operation is the same as the operation of the first embodiment 420. When Vi is higher than VT2, current will also flow through the second group of LEDs 452, causing a voltage drop across the current measuring sensor 672. When this voltage drop becomes higher than the forward base-emitter bias of the transistor 673, the transistor starts to draw current causing the voltage drop across the first resistor 461 to increase and hence the voltage across the first group of LEDs 451 to decrease, so that Ll decreases with increasing input voltage Vi. FIG. 6B is a graph comparable to FIG. 4B, showing that Ll eventually becomes equal to zero.

Figure 6C:
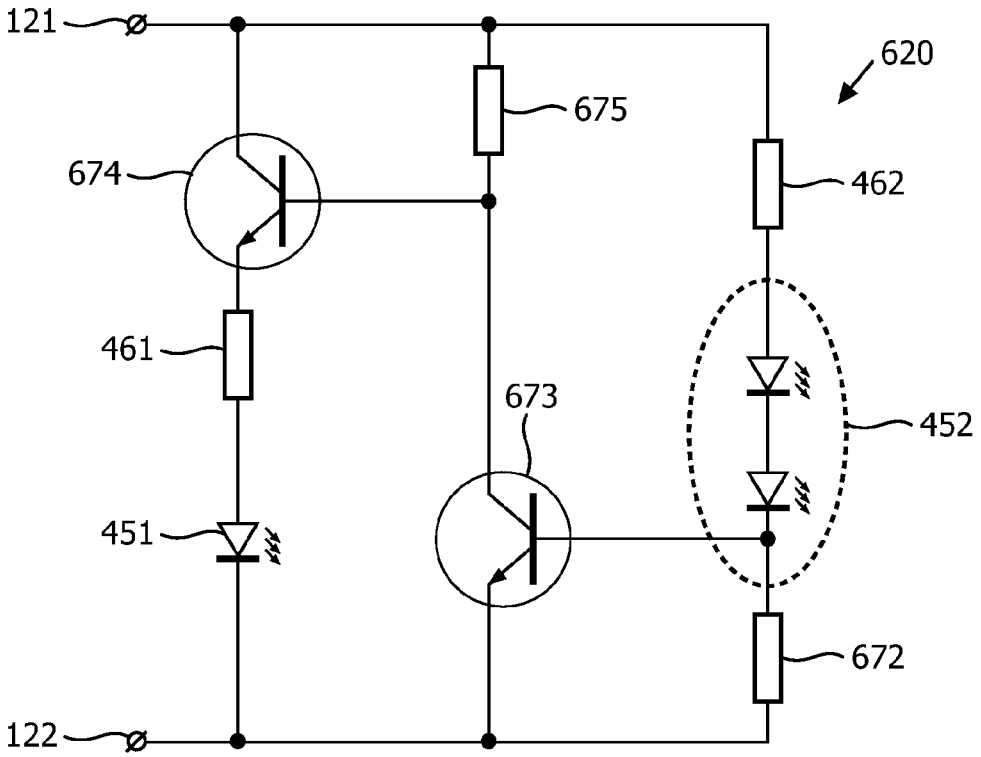
FIG. 6C is a block diagram schematically illustrating a possible embodiment of the LED system according to the present invention.

In the case of high Vi, the current through the first resistor 461 becomes equal to Vi/R1, which may be relatively high if R1 is relatively low. This is avoided in the fifth embodiment of LED system 780 of FIG. 6C, where the collector-emitter path of a second NPN transistor 674 is arranged between the first input terminal 121 and the first resistor 461. A bias resistor 675 is connected between the first input terminal 121 and the base terminal of said second NPN transistor 674. The collector terminal of the first NPN transistor 673 is connected to the node between the bias resistor 675 and the base terminal of said second NPN transistor 674. The operation is basically similar to the operation of LED system 620: when the input voltage rises above VT2, the increasing current in the second group of LEDs 452 will cause the base terminal of the second transistor 674 to be drawn to the level of the second input terminal 122, thus reducing and eventually cutting off the current in the first group of LEDs 451. Now the wasted current is limited by the bias resistor 675, which may have a much higher resistance than the first resistor 461.

What the embodiments described above have in common is that the light production response as a function of the input voltage Vi is mutually different for the individual groups of LEDs. This is caused by the groups having mutually different threshold voltages or receiving mutually different supply voltages derived from the input voltage, or both. Further, the ratio between the individual light outputs of the individual groups of LEDs is not constant. This even applies if the voltage-dependencies of the individual groups (dL/dVi) are mutually equal, which can be seen in FIG. 4B by giving the two sloping curves the same angle. In some of the embodiments, a coupling between one group and another group results in a decrease of one light output while the other light input increases as a function of the input voltage. All in all, in all embodiments, the overall color point of the combined light output is not constant but travels a path in color space as a function of input voltage Vi (unless of course the LEDs all emit the same color).

Figure 6D:
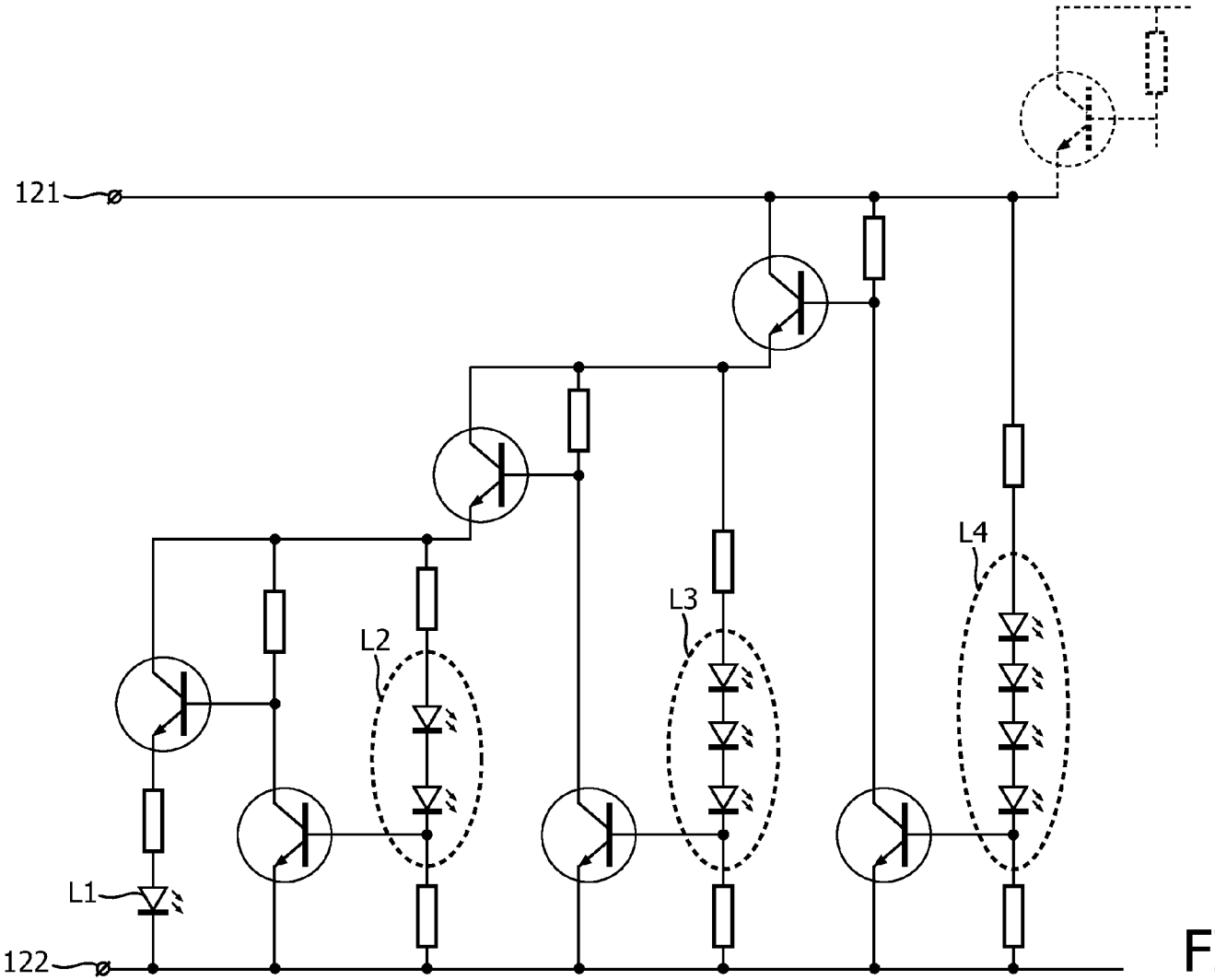
FIG. 6D is a block diagram schematically illustrating a possible embodiment of the LED system according to the present invention.

In the above, the invention has been explained with two groups of LEDs 451, 452. In such a case, the path traveled in color space is a straight line between the two color points corresponding to the two groups of LEDs. However, the inventive concept can be expanded in a modular fashion. So, it is possible to have a third group of LEDs, a fourth group of LEDs, etc, connected between the input terminals 121, 122, always with mutually different color point and mutually different threshold voltage. Broadly speaking, it is possible to have N groups of LEDs, each group being indicated as G(i), with i being an index ranging from 1 to N, N being a positive integer larger than 1. Each group G(i) has a group threshold voltage VG(i) and a color point CP(i). For two indices i, j with j>i, CP(j) ≠ CP(i) may apply, and preferably VG(j)>VG(i) applies. Each group G(i) is connected in series with at least one impedance. Two or more groups may be coupled such as to have one group influence the other group's response. For instance, two or more groups may have a common series impedance. Or a current reduction circuit for one group may be controlled by the current in another group. It is even possible to have an increasing current in group G(j) that reduces all the current in all groups G(i) with i<j; FIG. 6D schematically illustrates the modular layout of such a device.

In an LED system of practical interest, there are at least 3 LED groups of 3 mutually different color points, which may suitably be R, G, B, or there are at least 4 LED groups of 4 mutually different color points, which may suitably be R, G, B, W. In a preferred embodiment, it is possible to have 3 or 4 different voltage settings, respectively, each of said settings corresponding to a situation where only one of the groups is on while the other 2 or 3 groups, respectively, are off. In such a case, it is possible to render pure R, G, B and possibly W colors at will, on the basis of a correct selection of the driver output voltage.

Figure 7A:
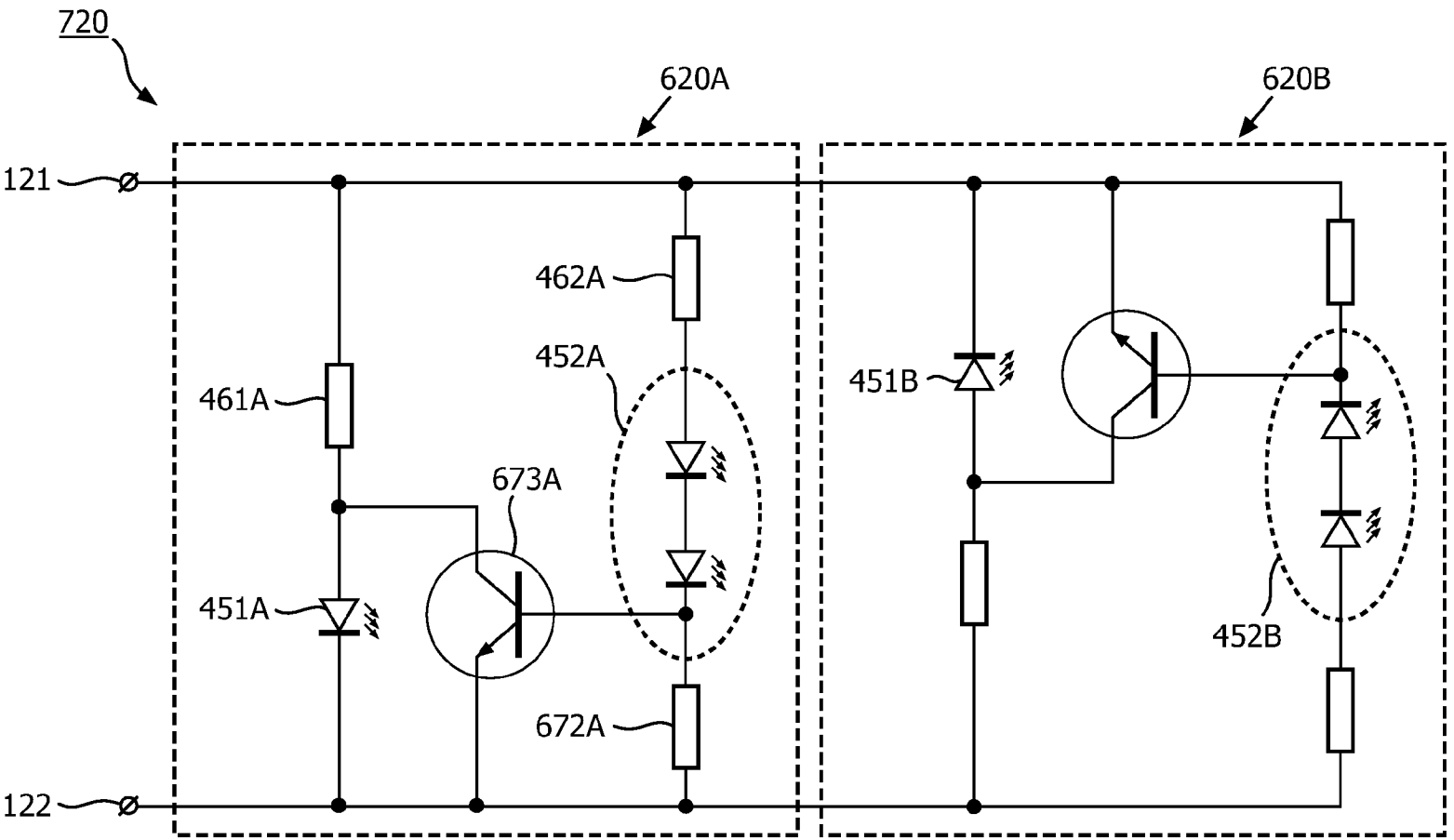
FIG. 7A is a block diagram schematically illustrating a possible embodiment of the LED system according to the present invention.
Figure 7B:
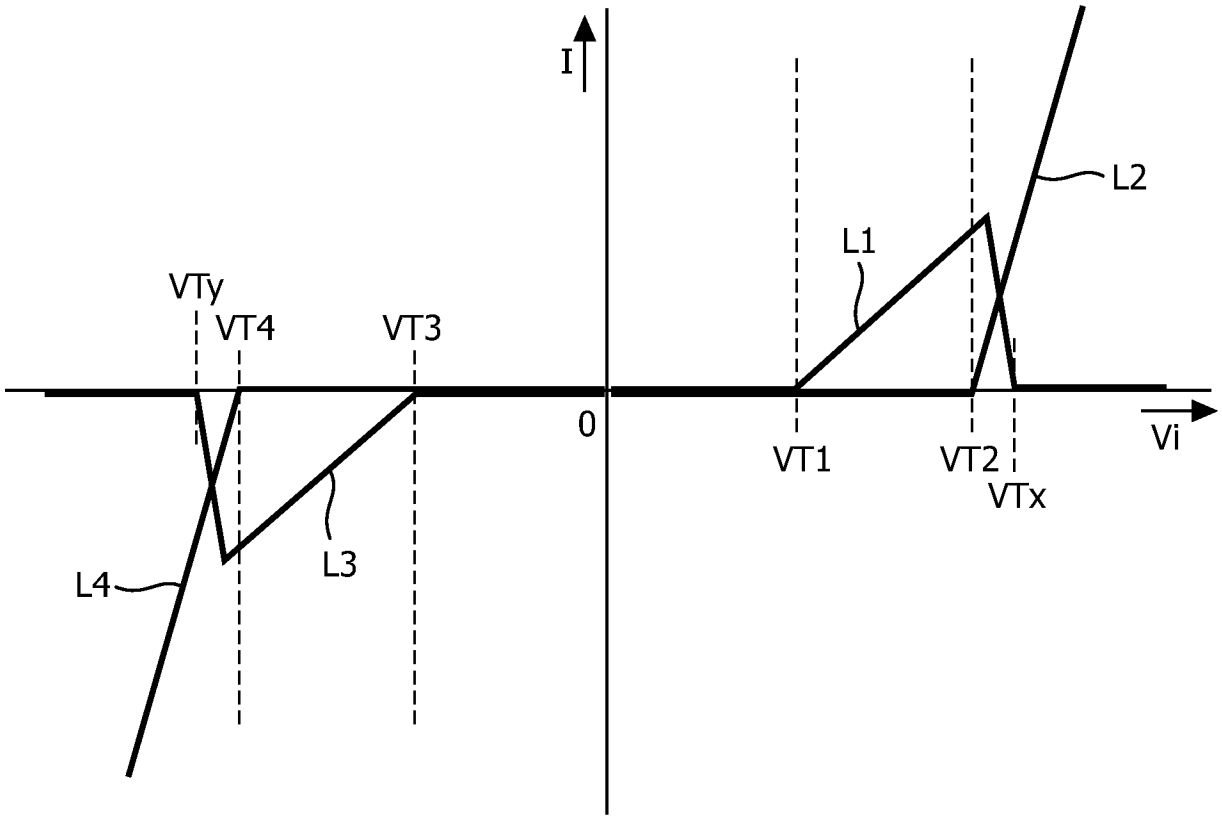
FIG. 7B is a graph showing the light output of the LED system of FIG. 7A as a function of the input voltage.

FIG. 7A illustrates an embodiment of an LED system 720 for a situation where the driver 130 is capable of providing a positive and a negative voltage. The LED system 720 comprises two systems 620 of FIG. 6A, individually distinguished as 620A and 620B, connected antiparallel between the input terminals 121, 122. When the voltage at the first input terminal 121 is positive with respect to the second input terminal 122, only the first system 620A is operative, and its operation is identical to the operation of LED system 620 as illustrated in FIG. 6B. When the voltage at the first input terminal 121 is negative with respect to the second input terminal 122, only the second system 620B is operative, and its operation again is identical to the operation of LED system 620 as illustrated in FIG. 6B. FIG. 7B illustrates the overal light output as a function of Vi. L1 indicates the light output of group 451A. L2 indicates the light output of group 452A. L3 indicates the light output of group 451B. L4 indicates the light output of group 452B. It can be seen that for VT1<Vi<VT2, the light output is pure L1;
for Vi>Vx, the light output is pure L2;
mfor VT4<Vi<VT3, the light output is pure L3;
for Vi<Vy, the light output is pure L4;

Thus, this LED system 720 is capable of selectively providing light having the color points R or G or B or W by a suitable selection of the driver output voltage.

Figure 8A:
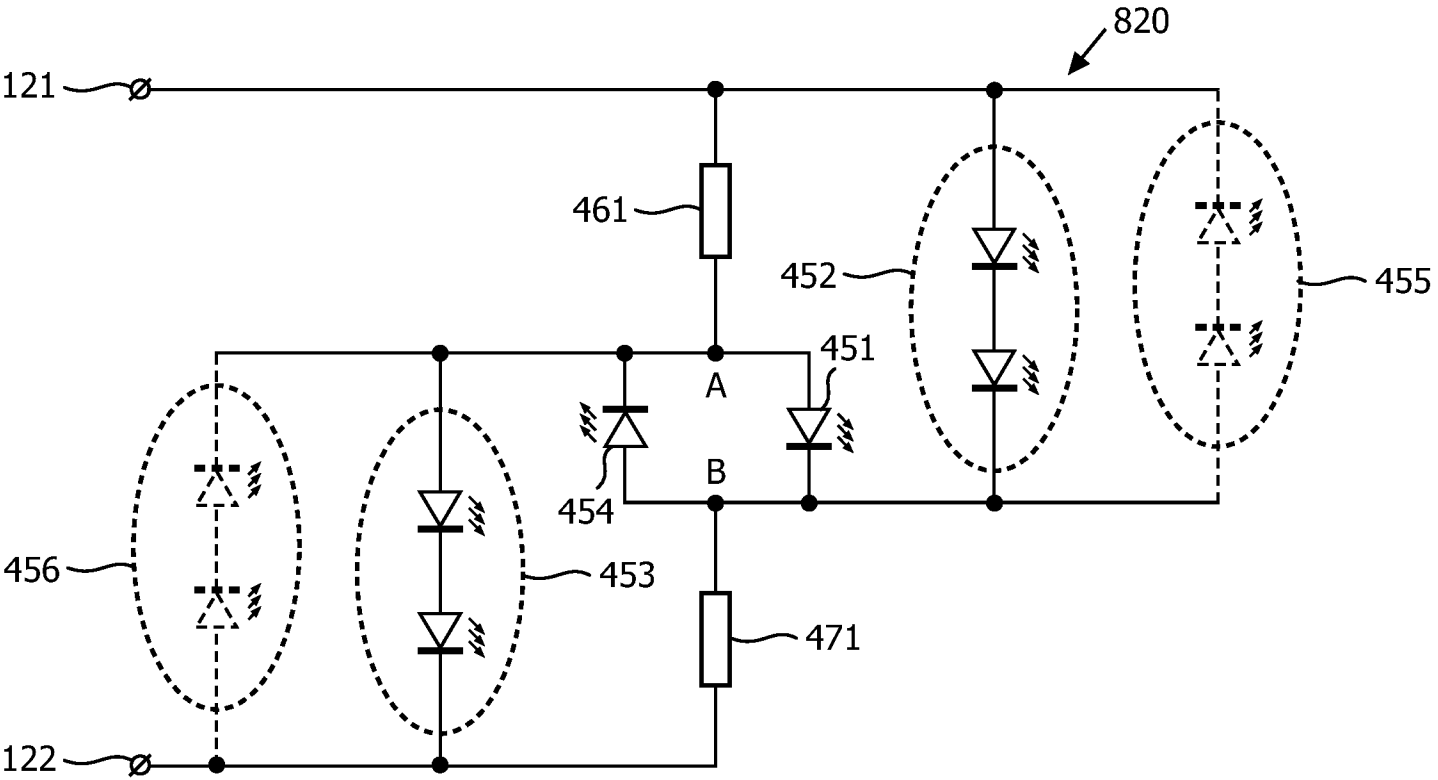
FIG. 8A is a block diagram schematically illustrating a possible embodiment of the LED system according to the present invention.

FIG. 8A illustrates an embodiment of an LED driver 820 that can be seen as a further elaboration of the embodiment 470 of FIG. 5A. The node between the first group of LEDs 451 and the first resistor 461 will be indicated as first node A, while the node between the first group of LEDs 451 and the common series resistor 471 will be indicated as second node B. While the second group of LEDs 452 is connected between the first input terminal 121 and the second node B, this embodiment 820 comprises a third group of LEDs 453 connected between the first node A and the second input terminal 122. Further, this embodiment comprises a fourth group of LEDs 454 connected antiparallel with respect to the first group 451 between the first and the second node A and B, respectively.

The third group 453 may have a third threshold voltage VT3 equal to or larger than the second threshold voltage VT2. The fourth group 454 has a fourth threshold voltage VT4. The third group has a third color point and the fourth group has a fourth color point.

Figure 8B:
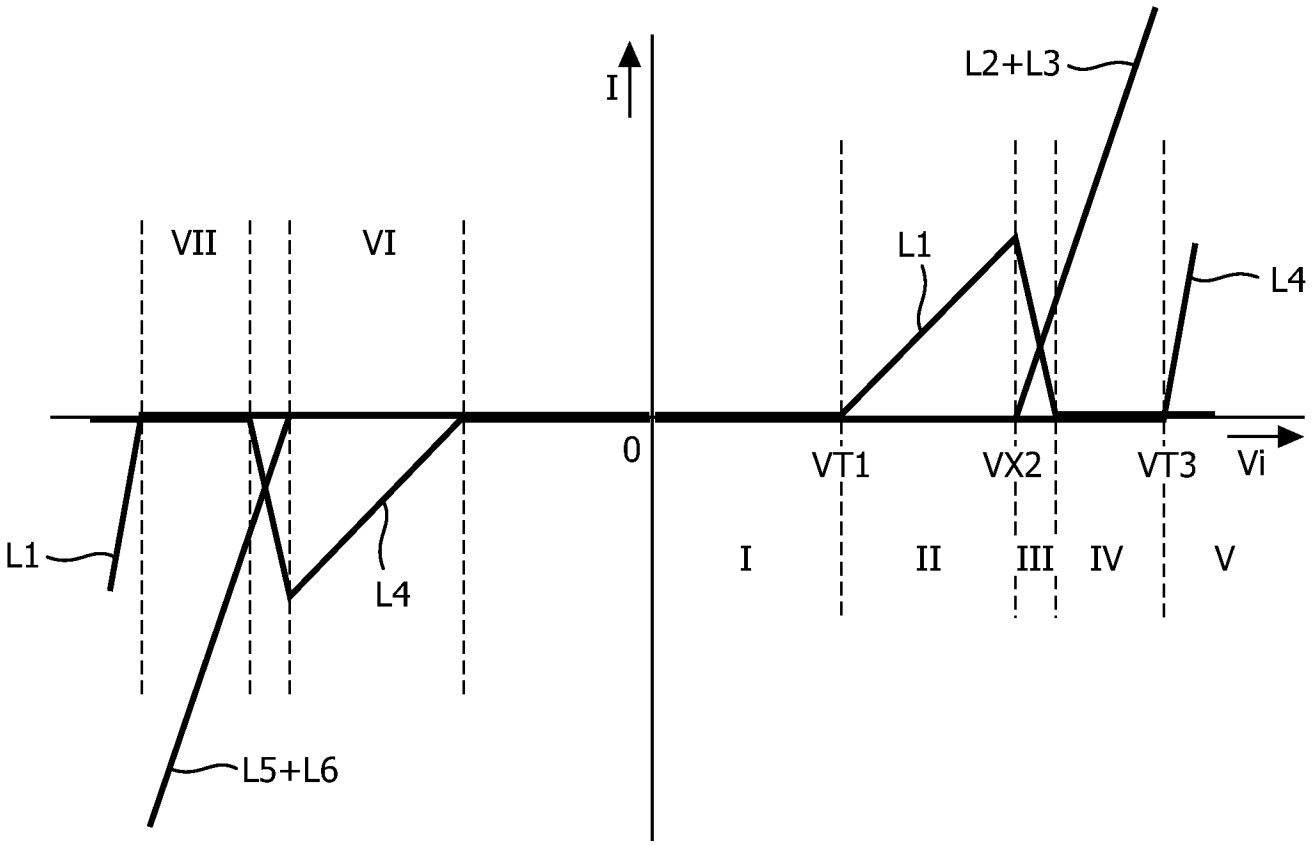
FIG. 8B is a graph showing the light output of the LED system of FIG. 8A as a function of the input voltage.

With reference to FIG. 8B, in which it is assumed that VT2=VT3, the operation is as follows. Five different voltage ranges I, II, III, IV and V can be distinguished.

In a first voltage range I, Vi is smaller than VT1 and no current will flow.

In a second voltage range II, Vi is larger than VT1, and current only flows in the path formed by the series arrangement of resistor 461, first LEDs 451, and resistor 471. A voltage drop equal to VT1 will develop across the first LEDs 451. The voltage drop V461 across resistor 461 will be equal to $$V461=R461\times(Vi-VT1)/(R461+R471)$$

and the voltage drop V471 across resistor 471 will be equal to $$V471=R471\times(Vi-VT1)/(R461+R471)$$

with R461 and R471 indicating the resistance of the resistors 461 and 471, respectively. In a practical embodiment, R461=R471.

In a fourth voltage range IV, current only flows in a second and a third current path formed by the series arrangements of the second group 452 and resistor 471 and the series arrangements of the third group 453 and resistor 461, respectively. No current flows in the first group 451. The voltage VA at the first node A will be equal to VT3, and the voltage VB at the second node B will be equal to Vi−VT2. Thus, the current in the second group 452 will be equal to (Vi−VT2)/R471, and the current in the third group 453 will be equal to (Vi−VT3)/R461.

In a third voltage range III between the second and fourth ranges, current flows in all of said paths, and first group 451, second group 452 and third group 453 are on. The precise current distribution between these paths will vary with Vi and will depend on the precise values of VT1, VT2, VT3, R461, R471. The lower boundary of the third voltage range III is determined by an input voltage level at which current flow becomes possible in the second or third path. As long as the voltage drop between first input terminal 121 and second node B, which can be expressed as V461+VT1 or as Vi−V471, is smaller than VT2, no current will flow in the second path. Current will start flowing in the second path as soon as Vi becomes higher than VX2, with $$VX2=VT1+(VT2-VT1)\times(R461+R471)/R461.$$

Likewise, as long as the voltage drop between node A and the second input terminal 122, which can be expressed as V471+VT1=Vi−V461, is smaller than VT3, no current will flow in the third path. Current will start flowing in the third path as soon as Vi becomes higher than VX3, with $$VX3=VT1+(VT3-VT1)\times(R461+R471)/R471.$$

The lower boundary of the third voltage range III is the lowest one of VX2 and VX3. In FIG. 8B, it is assumed that VX2=VX3.

The upper boundary of the third voltage range III is determined by an input voltage level at which current flow becomes impossible in the first path. In the fourth voltage range IV, the voltage difference between the two nodes A and B can be expressed as VT2+VT3−Vi. If this voltage difference is less than VT1, the first group 451 cannot conduct current. Thus, the upper boundary of the third voltage range III is equal to VT3+VT2−VT1.

While initially node A is positive with respect to node B, it follows from the above that node A is negative with respect to node B if Vi>VT2+VT3. If the negative voltage difference between nodes B and A becomes larger than VT4, the fourth group of LEDs 454 can conduct current. This occurs in a fifth range V where Vi>VT1+VT2+VT3.

The four color points may be mutually different. However, in a particular embodiment, the third group 453 has the same threshold voltage as the second group 452 and also has the same color point, while also the two resistors 461 and 471 have the same resistance value. In that case, the second and third groups are driven in a synchronous manner and produce the same light output color. In an advantageous embodiment, the first group 451 has a red color point, the second and third groups 452 and 453 have a white color point, and the fourth group 454 has a blue color point. Such an embodiment is particularly useful as a daylight lamp.

If the driver 130 is capable of providing a negative voltage, there will be a sixth operative range where current only flows in a fourth path defined by the series arrangement of second resistor 471, fourth group of LEDs 454, and first resistor 461. The description can be the same as for the second range II, with the first and fourth groups 451 and 454 having switched places. Then, the device is capable of rendering three pure colors by suitably setting the input voltage for the LED system.

The LED system 820 can be made completely symmetrical by adding a fifth group of LEDs 455 (curve L5 in FIG. 8B) antiparallel to the second group of LEDs 452 and a sixth group of LEDs 456 (curve L6 in FIG. 8B) antiparallel to the third group of LEDs, as illustrated in FIG. 8A in dotted lines. The color points of these fifth and sixth groups may be mutually equal. Further, the color points of these fifth and sixth groups may be equal to the color points of the second and third groups, but they may also be different to define a fourth color: in that case, there will be a seventh operative range where the output light only contains this fourth color, and the device is capable of rendering four pure colors by suitably setting the input voltage for the LED system.

In the above, it has been explained that the device of the present invention is capable of rendering different pure colors. In the following, it will be explained how any desirable mixed color can be rendered, as long as its color point is within the triangle or quadrangle defined by the three or four color points of the different pure colors. FIG. 9 is a graph schematically illustrating the output voltage of the driver 130 (hence input voltage Vi) as a function of time. The control device 2 controls the driver 130 so that the output voltage Vi is within the second operative range II from time tl to time t2, so the generated light output will have the first color point. From time t2 to time t3, the control device 2 controls the driver 130 so that the output voltage Vi is within the fourth operative range IV, so the generated light output will have the second/third color point. From time t3 to time t4, the control device 2 controls the driver 130 so that the output voltage Vi is within the sixth operative range VI, so the generated light output will have the color point of the fourth LEDs 454. From time t4 to time t5, the control device 2 controls the driver 130 so that the output voltage Vi is within the seventh operative range VII, so the generated light output will have the fourth color point of the fifth/sixth LEDs 455, 456. Now the control device 2 may repeat this sequence. The time interval from tl to t5 will be indicated as color period T. When this color period T is short enough, the human eye will not perceive a sequence of four different colors but rather a blend color; the precise color point of this blend color will depend on the precise durations of the four time intervals and on the precise voltage values within the four time intervals, as should be clear to a person skilled in the art.

Figure 9A:
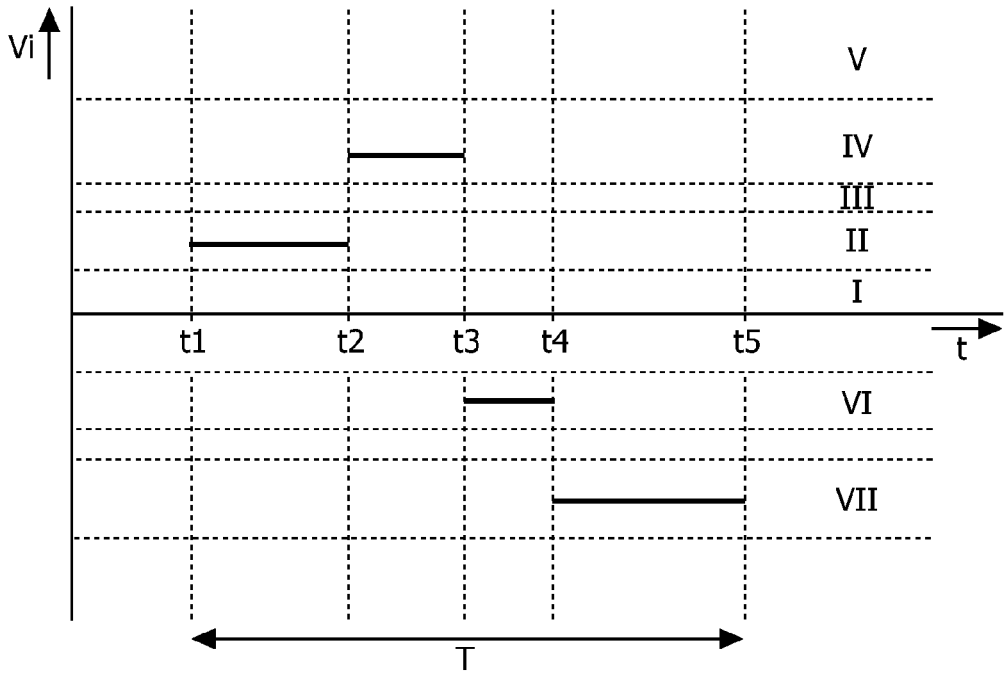
FIG. 9A is a graph schematically illustrating an output voltage of a driver as a function of time according to the present invention.

FIG. 9A illustrates that the driver's output voltage Vi is maintained constant during said time intervals, but that is not necessary. It is even not necessary that the output voltage Vi is controlled stepwise: it is for instance possible that the output voltage Vi is controlled to have a wave shape such as a sawtooth or a sine.

It is noted that it is also possible to generate mixed colors by operating in the third and/or fifth operative range, and the same applies to the corresponding operative ranges with inverted polarity.

Figure 9B:
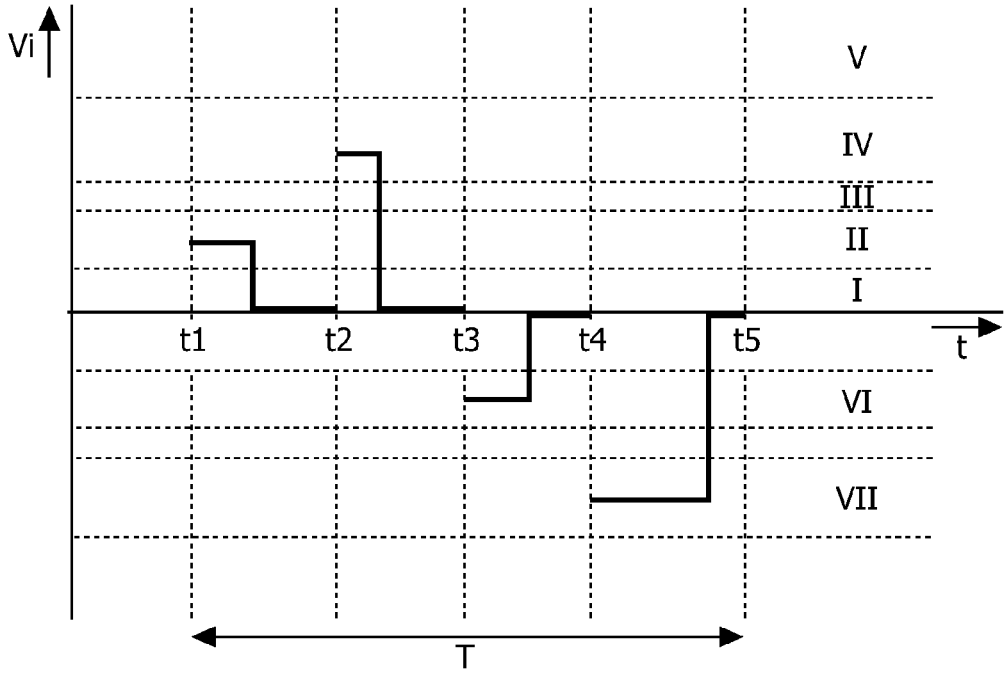
FIG. 9B is a graph schematically illustrating an output voltage of a driver as a function of time according to the present invention.

With respect to the operation of FIG. 9A, there are some limitations. In order to make control easier, and to make dimming possible, FIG. 9B shows a variation, wherein in each of the time intervals the voltage has the value discussed above for a first amount of time, and is zero for the remaining amount of time. By varying the duty cycle of the voltage in this time interval, the average intensity of the corresponding light output can be controlled between zero and a maximum.

Thus, the present invention succeeds in providing an illumination system comprising an LED system and a single driver for driving this LED system, with a two-wire connection between driver and LED system, which illumination system is capable of rendering all colors within the color triangle RGB, or any other color triangle.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims.

For instance, when the driver is a current source, the driver's output current can be used as a control parameter leading to a certain predetermined current distribution and hence output color.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope thereof.

In the above, the present invention has been explained with reference to block diagrams, which illustrate functional blocks of the device according to the present invention. It is to be understood that one or more of these functional blocks may be implemented in hardware, where the function of such (a) functional block(s) is performed by individual hardware components, but it is also possible that one or more of these functional blocks are implemented in software, so that the function of such (a) functional block(s) is performed by one or more program lines of a computer program or a programmable device such as a microprocessor, microcontroller, digital signal processor, etc.

The invention claimed is:

1. Illumination system comprising:

a light-emitting diode (LED) system comprising two or more LED groups and current distribution means, wherein each LED group includes one or more individual LEDs, the LED system having two input terminals, wherein each of the two or more LED groups is configured with a mutually different group color point and a mutually different group threshold voltage;

a single controllable driver for providing working power to the LED system, the driver having two output terminals coupled to the two input terminals of the LED system, respectively;

a control device for controlling the driver;

wherein the control device is designed for controlling the driver output voltage (Vi);

and wherein the current distribution means are responsive to the input voltage (Vi) at the input terminals of the LED system for drawing current from the driver and distributing the current among the different LED groups in dependence on the input voltage level (Vi).

2. Illumination system according to claim 1, wherein the current distribution means are designed to determine a LED group current for each LED group in dependence on the input voltage level (Vi), to provide each LED group with the corresponding LED group current, and to draw from the driver the summation of all LED group currents.

3. Illumination system according to claim 1, wherein there is at least one range of input voltages where only the current in one LED-group is non-zero, and wherein there is at least one second range of input voltages where only the current in a second LED-group is on-zero.

4. Illumination system according to claim 1, wherein the current distribution means are implemented by a hardware configuration of the LED system.

5. Illumination system according to claim 1, wherein the LED system comprises at least two LED groups connected in parallel to the LED system input terminals, wherein the group threshold voltage (VT1) of a first LED group is smaller than the group threshold voltage (VT2) of a second LED group, and wherein the group color point of the first LED group differs from the group color point of the second LED group.

6. Illumination system according to claim 5, wherein the first LED group is connected in series with a first impedance and wherein a series impedance value (R2) for the second LED group is smaller than the impedance value (R1) of the first impedance.

7. Illumination system according to claim 5, wherein at least one of said LED groups is coupled to the input terminals via a voltage divider.

8. Illumination system according to claim 5, wherein the parallel arrangement of said LED groups is connected in series with a common resistor.

9. Illumination system according to claim 5, further comprising:

a current sensor associated with the second LED group for sensing the current in the second LED group;

current suppressing means having an input coupled to receive an output signal from the current sensor;

wherein the current suppressing means are designed to progressively suppress current in the first LED group as the current magnitude increases in the second LED group.

10. Illumination system according to claim 1, wherein the driver is capable of providing a positive and a negative voltage, and wherein the system comprises a first LED system responsive to a positive driver voltage and a second LED system responsive to a negative driver voltage.

11. Illumination system according to claim 10, wherein the two LED systems are mutually identical and connected antiparallel to each other.

12. Illumination system according to claim 10, wherein the color points of the LEDs of the second LED system differ from the color points of the LEDs of the first LED system.

13. Illumination system according to claim 1, wherein the LED system comprises:

a series arrangement of a first resistor, a first LED group and a second resistor connected between its first and second input terminals, with a first node between the first resistor and the first LED group and a second node between the first LED group and the second resistor, wherein the first LED group has a first group threshold voltage and a first group color point;

a second LED group connected between the first input terminal and the second node, parallel to the first LED group, wherein the second LED group has a second group threshold voltage and a second group color point;

a third LED group connected between the first node and the second input terminal, parallel to the first LED group, wherein the third LED group has a third group threshold voltage and a third group color point;

a fourth LED group connected between the first node and the second node, antiparallel to the first LED group, wherein the fourth LED group has a fourth group threshold voltage and a fourth group color point;

wherein the second group threshold voltage is higher than the first group threshold voltage;

wherein the third group threshold voltage is higher than the first group threshold voltage and preferably equal to the second group threshold voltage;

wherein the second group color point differs from the first group color point;

wherein the third group color point differs from the first group color point and is preferably equal to the second group color point;

wherein the fourth group color point differs from the first group color point and from the second group color point.

14. Illumination system according to claim 13, wherein the driver is capable of providing a positive and a negative voltage, and wherein the LED system further comprises:

a fifth LED group connected between the first input terminal and the second node, antiparallel to the second LED group, wherein the fifth LED group has a fifth group threshold voltage and a fifth group color point;

a sixth LED group connected between the first node and the second input terminal, antiparallel to the third LED group, wherein the sixth LED group has a sixth group threshold voltage and a sixth group color point;

wherein the sixth group threshold voltage is higher than the fourth group threshold voltage;

wherein the sixth group color point differs from the fourth group color point;

wherein the fifth group color point differs from the fourth group color point and is preferably equal to the sixth group color point.

15. Illumination system according to claim 1, wherein the control device is designed to regularly change the output voltage of the driver such that, on average, the light output of the system has a desired color point as defined by an input signal received by the control device.

* * * * *